US010368620B2

(12) United States Patent
Rindlisbacher

(10) Patent No.: US 10,368,620 B2
(45) Date of Patent: Aug. 6, 2019

(54) PROTECTIVE CASES FOR MOBILE DEVICES

(71) Applicant: Stephen Rindlisbacher, Pleasant Grove, UT (US)

(72) Inventor: Stephen Rindlisbacher, Pleasant Grove, UT (US)

( * ) Notice: Subject to any disclaimer, the term of this patent is extended or adjusted under 35 U.S.C. 154(b) by 84 days.

(21) Appl. No.: 15/470,415

(22) Filed: Mar. 27, 2017

(65) Prior Publication Data

US 2018/0271241 A1 Sep. 27, 2018

(51) Int. Cl.

| | |
|---|---|
| ***B65D 85/00*** | (2006.01) |
| ***B65D 5/52*** | (2006.01) |
| ***B65D 25/24*** | (2006.01) |
| ***H05K 5/00*** | (2006.01) |
| ***H05K 5/02*** | (2006.01) |

(Continued)

(52) U.S. Cl.

CPC ..... *A45C 11/00* (2013.01); *A45C 13/002* (2013.01); *A45F 5/00* (2013.01); *A45C 2011/001* (2013.01); *A45C 2011/002* (2013.01); *A45C 2011/003* (2013.01); *A45C 2200/15* (2013.01)

(58) Field of Classification Search

CPC ..... A45F 5/00; A45F 2200/0516; A45F 2200/0508; A45F 2200/0525; A45C 2200/15; A45C 11/00; A45C 13/002; A45C 2011/001; A45C 2011/002; A45C 2011/003; B29L 2031/7276; F16M 13/005; F16M 13/02; F16M 13/022; F16M 11/04; F16M 11/40; F16M 11/10; F16B 2/00; H04B 1/3888; H04B 1/3877; H04M 1/04; H05K 5/023; G06F 1/163; G06F 1/166

USPC ..... 206/45.2, 320, 45.24, 592, 38; 312/297; 248/205.1, 274.1, 176.3, 451, 160, 175; 446/73; 445/575.1, 575.8; 224/929; D14/250–253

See application file for complete search history.

(56) References Cited

U.S. PATENT DOCUMENTS 5,655,999 A * 8/1997 Drew ..... F16M 13/00 482/148
5,799,980 A * 9/1998 McAdam ..... B42D 1/00 281/15.1

(Continued)

OTHER PUBLICATIONS

Breffo Website for Spiderpodium www.breffo.com accessed Sep. 21, 2018.*

(Continued)

*Primary Examiner* — Gideon R Weinerth
(74) *Attorney, Agent, or Firm* — Thorpe North & Western, LLP

(57) ABSTRACT

An assembly for holding and displaying a mobile device includes a mobile device case having engagement structure associated therewith, the engagement structure operable to retain the mobile device within the case. An arm restraint section is coupled to or formed in the case. At least two open sections are formed in the case adjacent the arm restraint section. At least one pliable arm has a first end, a second end and an intermediate section, the intermediate section being restrained by the arm restraint section of the case such that the first and second ends of the pliable arm extend through the open sections of the case and are free to move relative to the arm restraint section to enable a user to position the first and second ends of the pliable arm relative to the mobile device.

19 Claims, 5 Drawing Sheets

(51) Int. Cl.

| | |
|---|---|
| ***F16M 11/40*** | (2006.01) |
| ***A45C 11/00*** | (2006.01) |
| ***A45C 13/00*** | (2006.01) |
| ***A45F 5/00*** | (2006.01) |

(56) References Cited

U.S. PATENT DOCUMENTS 5,833,509 A * 11/1998 Hunt ..... A63H 3/003 446/73
5,875,792 A * 3/1999 Campbell, Jr. ..... A45D 2/18 132/246
5,931,560 A * 8/1999 Hoffman ..... A63H 3/003 362/124
7,270,255 B2 9/2007 Badillo et al.
7,597,225 B2 10/2009 Badillo et al.
D658,047 S * 4/2012 Mathews ..... D8/394
D663,294 S * 7/2012 Buxton ..... D14/250
D669,462 S * 10/2012 Avrahami ..... D14/253
D669,619 S * 10/2012 Ormsbee ..... D26/62
D679,701 S * 4/2013 Adelman ..... D14/253
D687,428 S * 8/2013 Kim ..... D14/253
8,616,422 B2 * 12/2013 Adelman ..... A45F 5/00 224/191
D701,212 S * 3/2014 Blevins ..... D14/447
D705,210 S * 5/2014 Adelman ..... D14/250
8,827,760 B2 * 9/2014 Ushibo ..... A63H 3/003 446/268
D715,803 S * 10/2014 Major ..... D14/447
D719,951 S * 12/2014 Fenton ..... D14/253
8,978,883 B2 3/2015 Gandhi et al.
D748,617 S * 2/2016 Zucker ..... D14/253
D755,153 S 5/2016 Steiner et al.
D756,980 S * 5/2016 Beeman ..... D14/250
9,345,310 B2 5/2016 Chiu, Jr. et al.
D759,023 S * 6/2016 Liu ..... D14/253
D763,857 S * 8/2016 Dang ..... D14/440
9,407,743 B1 8/2016 Hirshberg
9,709,213 B2 * 7/2017 Zheng ..... F16M 11/40
9,985,678 B1 * 5/2018 Sumida ..... H04B 1/3888
D832,830 S * 11/2018 Kim ..... D14/250
D839,257 S * 1/2019 Polseno, Sr. ..... D14/250
2008/0056808 A1 * 3/2008 Bevirt ..... F16M 11/40 403/56
2009/0095854 A1 * 4/2009 Forbes ..... F16M 11/40 248/176.3
2010/0021155 A1 * 1/2010 Orzeck ..... G03B 17/00 396/428
2010/0072334 A1 3/2010 Le Gette et al.
2010/0252696 A1 * 10/2010 Sage ..... F16M 11/40 248/160
2010/0259144 A1 10/2010 Bevirt et al.
2010/0294908 A1 * 11/2010 Mish ..... A47B 23/043 248/451
2010/0314508 A1 * 12/2010 Bevirt ..... F16M 11/041 248/121
2012/0006950 A1 * 1/2012 Vandiver ..... F16M 11/10 248/176.3
2012/0019113 A1 * 1/2012 Hale ..... G06F 1/1628 312/223.1
2012/0074291 A1 * 3/2012 Fu ..... F16M 11/10 248/560
2012/0091307 A1 * 4/2012 Haynes ..... A47B 23/043 248/451
2012/0106091 A1 * 5/2012 Huang ..... H04M 1/04 361/727
2012/0187259 A1 * 7/2012 Cheng ..... F16M 11/10 248/188.6
2013/0026316 A1 * 1/2013 Case ..... B62J 11/00 248/205.1
2013/0193909 A1 * 8/2013 Blevins ..... F16M 11/10 320/107
2013/0233986 A1 * 9/2013 Rasheta ..... G03B 17/561 248/205.1
2014/0061087 A1 * 3/2014 Mao ..... A45C 11/00 206/521
2014/0199911 A1 * 7/2014 Shamus ..... A63H 3/04 446/73
2014/0326847 A1 * 11/2014 Barr ..... F16M 11/40 248/455
2014/0346306 A1 * 11/2014 Mayfield ..... A47B 23/043 248/455
2015/0108313 A1 4/2015 Leung
2015/0136644 A1 * 5/2015 Major ..... A45C 11/00 206/736
2015/0151880 A1 * 6/2015 Baschnagel ..... B43L 1/00 224/191
2015/0156297 A1 6/2015 Crawford et al.
2015/0175309 A1 * 6/2015 McGowan ..... B65D 25/2882 224/191
2015/0358044 A1 * 12/2015 Barstead ..... H04B 1/3888 455/575.1
2015/0382489 A1 * 12/2015 Sorensen ..... G06F 1/16 248/558
2016/0045002 A1 * 2/2016 Butts ..... A45C 11/00 224/191
2016/0101902 A1 4/2016 Kim
2016/0249472 A1 8/2016 Tu
2016/0286016 A1 * 9/2016 Lee ..... H04M 1/04
2016/0308571 A1 10/2016 Chiang et al.
2016/0345695 A1 * 12/2016 Stagge ..... A45C 11/00
2017/0201286 A1 * 7/2017 Qian ..... H04B 1/3888
2017/0234478 A1 * 8/2017 Ren ..... F16M 11/38 361/679.56

OTHER PUBLICATIONS

Appitoz, "Black Flexible Toy Robot Rubber Arms Legs Case for Apple iPhone 4S 4 4G." https://www.amazon.com/APPITOZ-BLACK-FLEXIBLE-RUBBER-iPHONE/dp/B009K2S04W/ref=cm_cr_arp_d_pl_foot_top?ie=UTF8; 1 Page.

Borrel, "The Glif Iphone 4 Tripod Mount Does Much Much More." Wired; https://www.wired.com/2010/10/the-glif-iphone-4-tripod-mount-does-much-much-more/; Oct. 5, 2010, 5 Pages.

GLIF, "Adjustable Tripod Mount & Stand for Smartphones (Apple iphone, Samsung, HTC, etc.)" http://www.amazon.com/Glif-Adjustable-Tripod-Smartphones-Samsung-dp/B00HQO5VJ8; 1 Page.

Greatshield, "GreatShield Legacy Series Ultra Slim Fit Dual Layer Hybrid Case with Kickstand for Apple iPhone 5/5S." https://www.amazon.com/GreatShield-Legacy-Hybrid-Kickstand-iPhone/dp/B009GMXP6/ref=redir_mobile_desktop?_encoding=UTF8&pi=SY200_QL40&qid=1415591477&ref_=mp_s_a_1_l&rs=8-1; 1 Page.

Jexon Technology-Store, "New Arrival Colorful Soft TPU Kick-stand Case for Apple iPhone 6 / 6 Plus Back Cover Case for iphone 6 Plus +Body Stand Holder." https://www.aliexpress.com/store/product/New-arrival-Colorful-Soft-TPU-Kickstand-Case-for-Apple-iphone-6-6-Plus-Back-Cover-Case/1299467_3244235188.html; 1 Page.

Nbryte, "Tablift Tablet Stand for the Bed, Sofa, or Any Uneven Surface." https://www.amazon.com/Tablift-Tablet-Stand-Uneven-Surface/dp/B01AHGIDE6/ref=sr_1_1?ie=UTF8&qid=1498589096&sr=8-1-spons&keywords=tablift+tablet+stand&psc=1; 1 Page.

Octa, "Octa Monkey Kit-Suction-Based Tablet Stand for iPad, Galaxy, Surface and More." https://www.amazon.com/Octa-Monkey-kit-Suction-Based-Surface/dp/B00C1Q6H2Y/ref=cm_cr_arp_d_pl_foot_top?ie=UTF8; 1 Page.

Omax, "Bendable Octopus Universal Flexible Adjustable ipad Tablet Stand Holder Mounts Black Colour." https://www.amazon.co.uk/Bendable-octopus-Universal-Flexible-Adjustable/dp/B00KNFIIIA; 1 Page.

Peta Pixel, "Tripod Adapter and Case for the iPhone 4 by Xshot." https://petapixel.com/2010/11/19/tripod-adapter-and-case-for-the-iphone-4-by-xshot/; 2 Pages.

Rienar, "Rienar Universal Multi-Function Portable Spider Flexible Grip Holder for Smartphones and Tablets." http://www.amazon.com/Rienar-Universal-Multi-Function-Portable-Smartphones/dp/B00P8XBNOY/ref=pd_lpo_vtph_107_bs_lp_tr_t_2?_encoding=UTF8&psc=1&refRID=CBVYFHEHMNG5ESIWWD9D; 1 Page.

(56) References Cited

OTHER PUBLICATIONS

SW-BOX, "SpiderDock-Iphone 4S Podium (Black + Fits and Cell-phone)." http://www.sw-box.com/SpiderDock-iPhone-5-Podium-Black-fits-any-cellphone.html; 1 Page.

* cited by examiner

PROTECTIVE CASES FOR MOBILE DEVICES

FIELD OF THE INVENTION

The present invention relates generally to protective cases for securing mobile devices. More particularly, the invention relates to protective cases that can be used to secure a mobile device relative to an auxiliary structure.

FIELD OF THE INVENTION

Mobile devices, such as cellular phones, tablets, digital music players and the like, are used daily, if not hourly, by many consumers. As the use of such products has grown, so has the concern on the part of consumers to both ensure that such products are protected from damage, and to increase the ease with which such products can be viewed and/or manipulated for use. A myriad of differing cases, display stands, holders, straps and the like have been developed to address these needs.

While it is a relatively straightforward matter to develop a mobile device case that protects a mobile device from damage, conventional devices have been found lacking by consumers who desire a protective case that can also serve to securely and safely display mobile devices for use and/or viewing.

SUMMARY OF THE INVENTION

In accordance with one aspect of the invention, an assembly for holding and displaying a mobile device is provided, including a mobile device case having engagement structure associated therewith, the engagement structure operable to retain the mobile device within the case. An arm restraint section can be coupled to or formed in the case. At least two open sections can be formed in the case adjacent the arm restraint section. At least one pliable arm can have a first end, a second end and an intermediate section, the intermediate section being restrained by the arm restraint section of the case such that the first and second ends of the pliable arm extend through the open sections of the case and are free to move relative to the arm restraint section to enable a user to position the first and second ends of the pliable arm relative to the mobile device.

In accordance with another aspect, an assembly for holding and displaying a mobile device is provided, including a mobile device case capable of securely holding a mobile device, the mobile device case including a rear surface. A pair of openings can be formed through the rear surface of the mobile device case. A pliable arm can have a first end and a second end and an intermediate section between the first and second ends. The intermediate section of the pliable arm can be restrained by a portion of the rear surface of the mobile device case while each of the first and second ends of the pliable arms extend through one of the pair of openings.

In accordance with another aspect, an assembly for holding and displaying a mobile device is provided, including a mobile device case having engagement structure associated therewith, the engagement structure operable to retain the mobile device within the case. An arm restraint section can be coupled to or formed in the case. At least four open sections can be formed in the case adjacent the arm restraint section. A pliable assembly can include: at least two pliable arms, each arm having first and second ends and an intermediate section therebetween; and a brace, connecting the intermediate sections of the at least two pliable arms. The pliable assembly can be retained by the arm restraint section such that first and second ends of each of the pair of pliable arms are free to move relative to the mobile device.

There has thus been outlined, rather broadly, relatively important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 1:
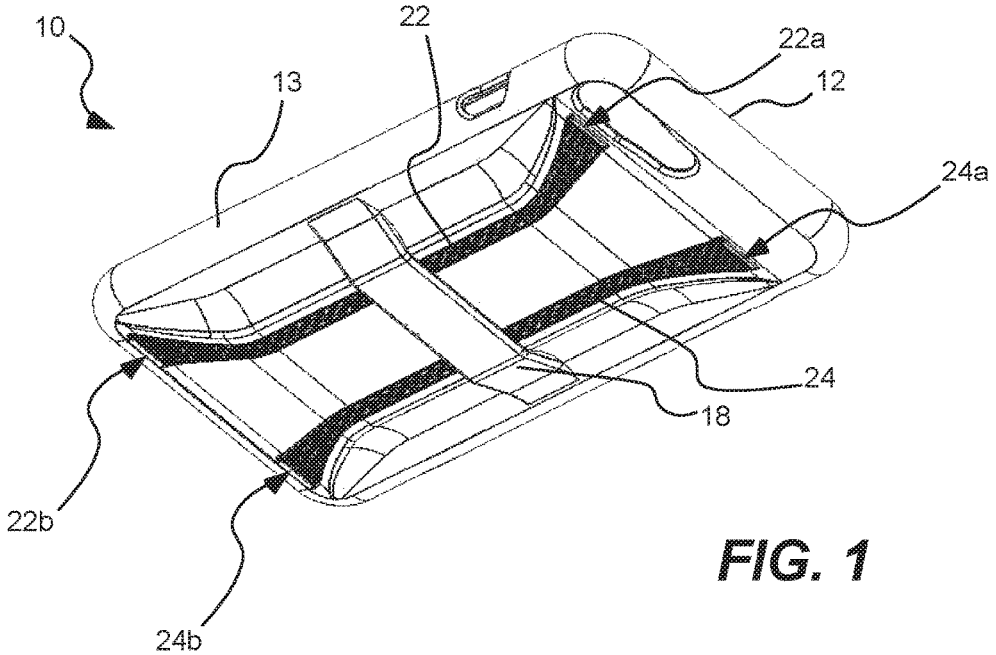
FIG. 1 is a bottom perspective view of a mobile device protective case in accordance with an embodiment of the invention.

Before the present invention is disclosed and described, it is to be understood that this invention is not limited to the particular structures, process steps, or materials disclosed herein, but is extended to equivalents thereof as would be recognized by those of ordinarily skilled in the relevant arts. It should also be understood that terminology employed herein is used for the purpose of describing particular embodiments only and is not intended to be limiting.

It must be noted that, as used in this specification and the appended claims, the singular forms "a" and "the" include plural referents, unless the context clearly dictates otherwise. Thus, for example, reference to a "pliable leg" can, but does not necessarily, include one or more of such legs.

Definitions

In describing and claiming the present invention, the following terminology will be used in accordance with the definitions set forth below.

As used herein, the term "pliable" is to be understood to refer broadly to a variety of materials that can be reconfigured from an initial orientation into an altered orientation, after which the material remains in the altered orientation. Pliable legs of the present technology can be positioned into a variety of configurations or orientations and can afterward maintain this reconfigured position. Examples of pliable materials suitable for this purpose include, without limitation, metals such as steel, aluminum, titanium, combinations and composites containing such materials, etc.

As used herein, the term "flexible" is to be understood to refer to a material that can be deflected or deformed from an initial orientation and can elastically return to this initial orientation after being deformed. Examples of suitable flexible materials include, without limitation, rubber, silicone, PVC (polyvinyl chloride), etc.

As used herein, the terms "upper," "lower," "elevation," "height," and the like, are to be understood to refer to relative locations and/or displacements of various elements or components discussed in the present disclosure. These terms are used to more clearly claim and describe the various elements or components of the invention and, unless the context clearly indicates otherwise, are not to be construed as limiting the invention to any particular embodiment.

As used herein, the term "substantially" refers to the complete or nearly complete extent or degree of an action, characteristic, property, state, structure, item, or result. As an arbitrary example, an object that is "substantially" enclosed is an object that is either completely enclosed or nearly completely enclosed. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As an arbitrary example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Invention

As illustrated by example in the figures, the present invention generally provides a protective case that can be used in conjunction with a variety of electronic mobile devices. Examples of mobile devices with which the present technology can be used include, without limitation, cellular phones, tablets, personal digital assistants ("PDAs"), GPS units, portable musical players, wearable electronic devices, and the like. The protective cases of the present technology can advantageously include structure that allows the protective case, while carrying/protecting the mobile device, to be temporarily attached to an auxiliary structure, or be positionable while supported by an auxiliary structure.

Figure 8:
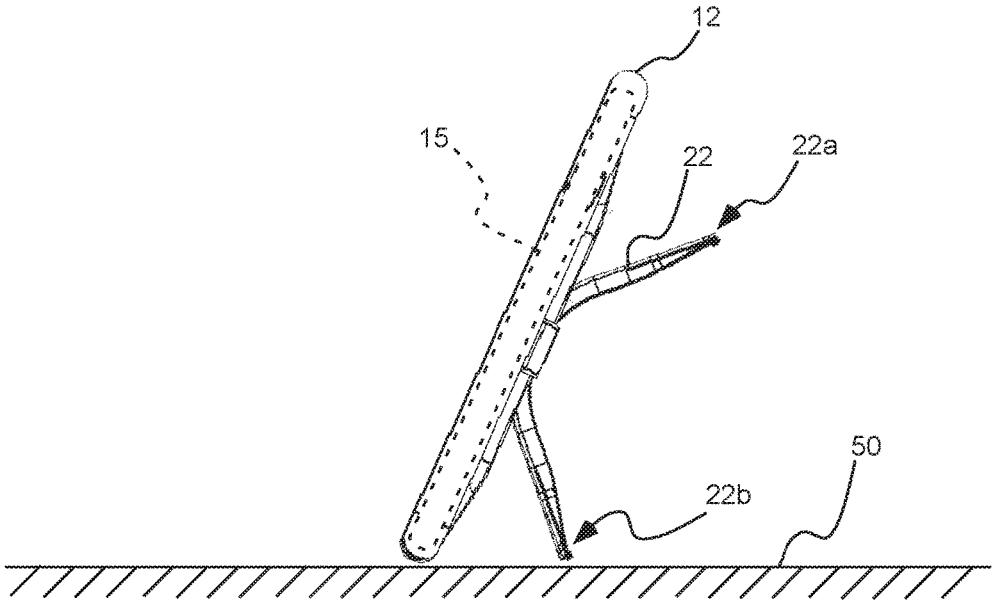
FIG. 8 is a side view of a the mobile device case of FIG. 7, supported relative to an auxiliary structure.

As shown in the figures, in one aspect of the invention, there is provided an assembly 10 for holding and displaying a mobile device (an exemplary mobile device is shown at 15 in FIG. 8). The assembly can include a mobile device case 12 having engagement structure associated therewith. The engagement structure is operable to retain the mobile device within the case (or, phrased another way, to retain the case about the mobile device). In the examples shown, the engagement structure can include two or more sidewalls walls (16, in FIG. 4) operable to engage the mobile device and secure it within the mobile device case.

Figure 5:
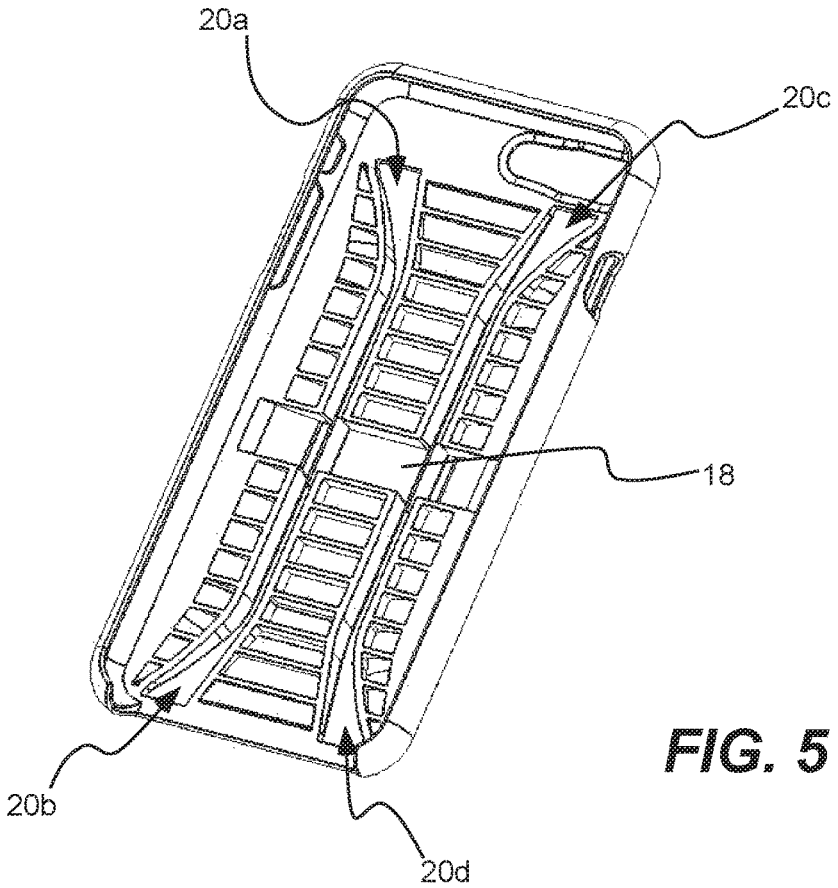
FIG. 5 is a top perspective view of a device case in accordance with an aspect of the invention.

The case 12 can include an arm restraint section 18 that can be coupled to or formed in the case. At least two open sections (best seen in FIG. 5 at 20*a*, 20*b*, 20*c* and 20*d*) can be formed in or through the case adjacent the arm restraint section. At least one pliable arm (two are shown in the figures, 22 and 24) can include a first end 22*a*, 24*a*, respectively, a second end 22*b*, 24*b* and an intermediate section 22*c*, 24*c*. The intermediate section can be restrained by the arm restraint section 18 of the case such that the first and second ends of the pliable arm extend through the open sections of the case and are free to move relative to the arm restraint section to enable a user to position the first and second ends of the pliable arm relative to the mobile device.

Figure 2:
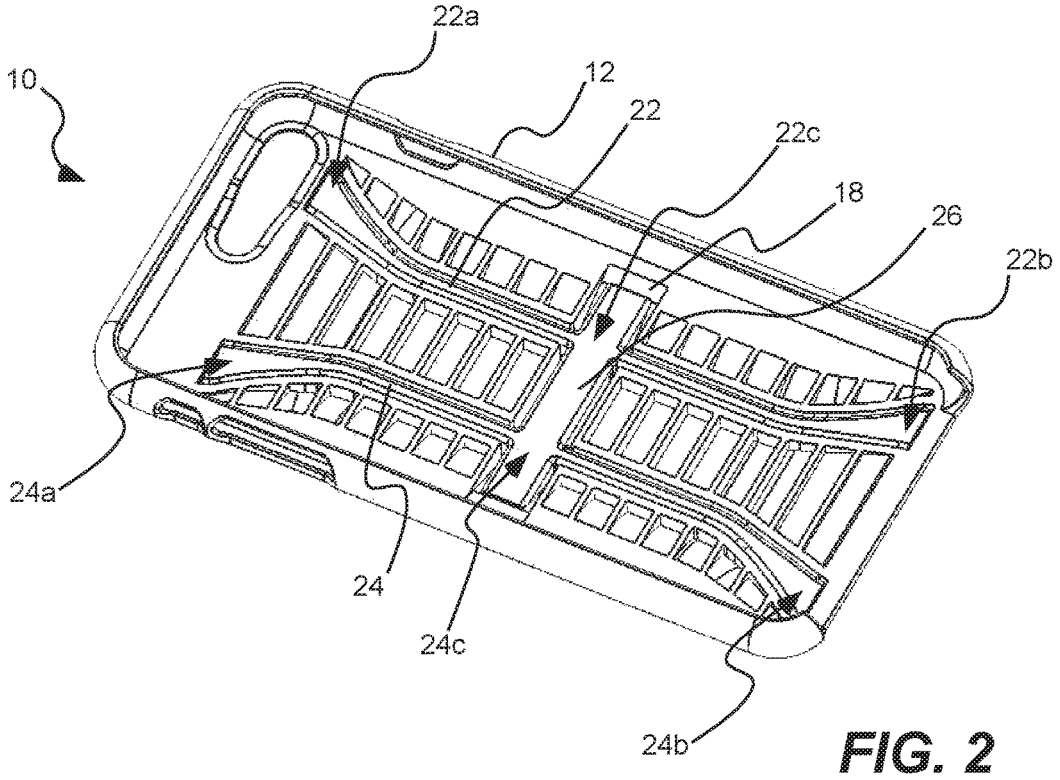
FIG. 2 is a top perspective view of the protective case of FIG. 1.

The assembly 10 is shown in FIGS. 1 and 2 with the pliable arms configured in an initial, storage configuration or orientation. In this configuration, the case 12 can include a rear outer surface 13 (FIG. 1). When in the storage orientation (that shown in FIGS. 1 and 2), all portions of the pliable arms 22, 24 can be stored below or beneath this rear outer surface. In this manner, the case, along with the pliable arms, can be easily placed into a user's pocket without the arms interfering with insertion into or retraction of the device from a pocket (or purse or briefcase or the like). That is, the arms are not likely to "catch" or "snag" a pocket or container during storage in or removal from the pocket or container.

To facilitate this feature, in one embodiment of the invention, the at least two open sections 20*a*, 20*b*, etc., formed in the case can include a shape that corresponds to a shape of the first and second ends 22*a*, 22*b*, etc., of the pliable arms 22, 24. Thus, in the embodiment shown in FIG. 1, the shape of pliable arms 22, 24 corresponds to the openings 20*a*, 20*b*, 20*c* and 20*d*. This aids in allowing the pliable arms to remain stored in the case, and below the case outer surface 13, when not in use.

When desired, however, the pliable arms 22, 24 can be moved from the storage configuration or orientation of FIGS. 1 and 2 into an extended, display orientation, as shown for example in FIGS. 3, 4, 7 and 8. In this orientation, the pliable arms can be extended and positioned, twisted, bent, etc., into a variety of orientations. An exemplary few of these orientations are shown in the referenced figures. Regardless of the orientation, position, etc., in which the arms are positioned, the arm restraint section 18 maintains the arms securely attached relative to the case 12. Thus, the arms can be positioned, twisted, wrapped, etc., while a secure connection is maintained between the arms and the case. The arms are very difficult, if not impossible, to remove from the case when the mobile device is stored within the case.

In the examples shown, the arms 22, 24, are trapped or "sandwiched" between the arm restraint section 18 and the mobile device 15. This secure connection can ensure that the arms are not easily pulled from engagement with the case, yet also allows the arms to be formed from a different material than the case, and/or in a different process than that in which the case is formed. In this manner, the optimal material and/or manufacturing process can be utilized for manufacture of the case 12 and also for the arms 22, 24. The manner in which the arms are retained by the case (by way of openings 20*a*, 20*b*, etc., and restraint section 18) advantageously ensures a secure connection between the arms and the case.

Figure 3:
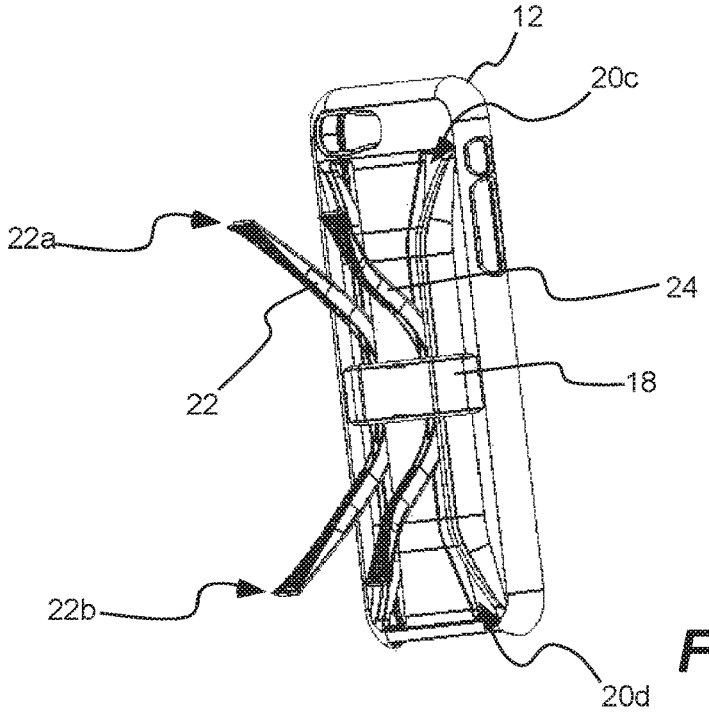
FIG. 3 is a bottom perspective view of the protective case of FIG. 1, shown with a pair of pliable legs extended into a display orientation.
Figure 4:
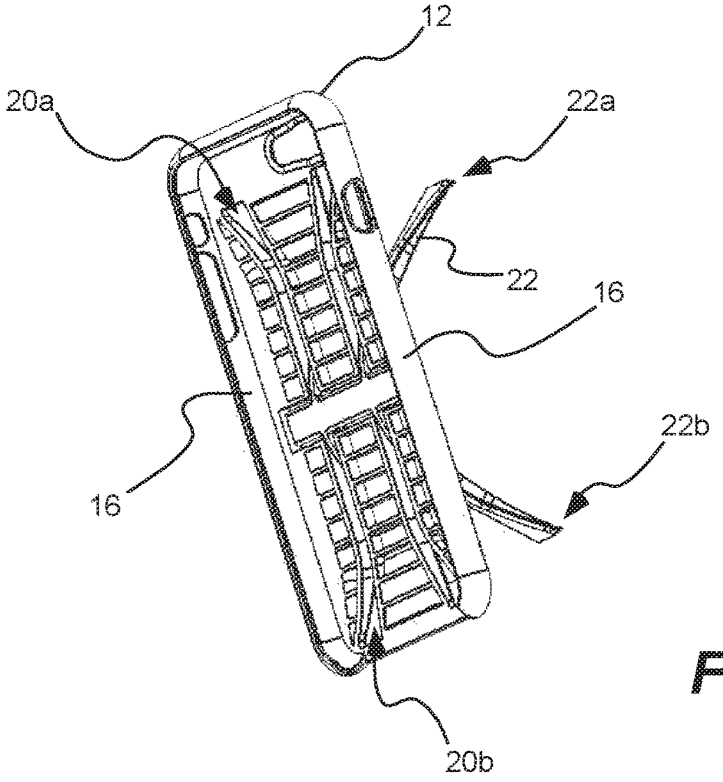
FIG. 4 is a top perspective view of the protective case of FIG. 3.
Figure 7:
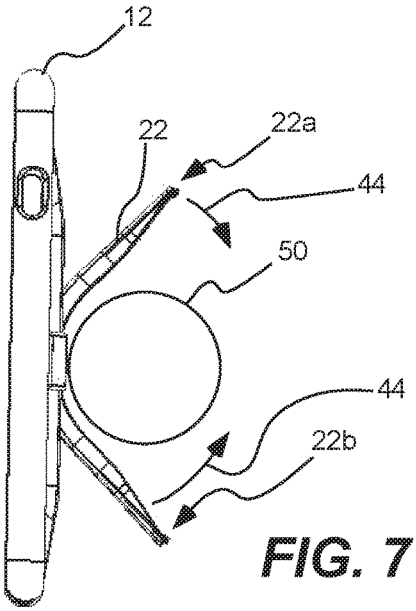
FIG. 7 is side view of a mobile device protective case engaging an auxiliary structure in accordance with an aspect of the invention.

FIGS. 3 and 4 generally show the pliable arms 22, 24 in the extended, display orientation. FIGS. 7 and 8 illustrate two exemplary manners in which the arms can be extended into the display orientation to allow a consumer to position the mobile device 15 in a particular manner. As shown in FIG. 7, the mobile device case 12 can advantageously be mounted to some auxiliary structure 50, which is illustrated schematically for exemplary purposes only. The auxiliary structure can take a variety of forms: in the example shown in FIG. 7, it is a rod-like structure such as that found on exercise equipment, furniture, human anatomy (i.e., a wrist or fingers), automobile features, etc. As shown in FIG. 8, the auxiliary structure 50 can be a generally planar surface on which the arms and case can be rested.

The pliable arms 22, 24 can be configured such that a user can position them in a desired orientation and the arms will remain in that orientation. Thus, the arms can be relatively easily moved from one configuration to another, after which they will remain in that configuration. When used in connection with the auxiliary structure illustrated in FIG. 7, the arms can be wrapped securely about the auxiliary structure (along directional indicators 44, for example). Once so wrapped, the case 12 (and thus the mobile device 15) will be securely held adjacent the auxiliary structure. In this manner, a user can attach his or her mobile device to a structure, and have the mobile device remain in this position for viewing, input, etc. This can advantageously provide a hands-free arrangement to allow the user to view (and provide input to) the mobile device without having to hold the device in his or her hands.

As will be appreciated, the case 12 can be oriented relative to the auxiliary structure of FIG. 7 at a variety of angles—providing the user nearly unlimited adjustment options. Similarly, in the situation shown in FIG. 8, the pliable leg 22 (and accompanying leg 24, hidden from view) can be positioned at a desired angle and height to allow the mobile device case 12 (and the mobile device 15) to be positioned as a user desires. The present technology can be used to securely support a mobile device in a sideways orientation, upside-down orientation, horizontal, vertical, portrait, landscape, etc.

The pliable arms 22, 24 can be formed in a variety of manners. As discussed above, since the pliable arms are retained within the case 12 by way of arm restraint section 18, the arms and case can generally be easily separable from one another when the mobile device is not retained within the case. This feature enables replacement of the case or arms independently of one another. This feature also allows a user to easily interchange different arms with different cases, as may be desired for particular structural applications (e.g., to provide a more robust support for active situations) or aesthetic reasons (e.g., to obtain a desired color scheme).

Figure 6:
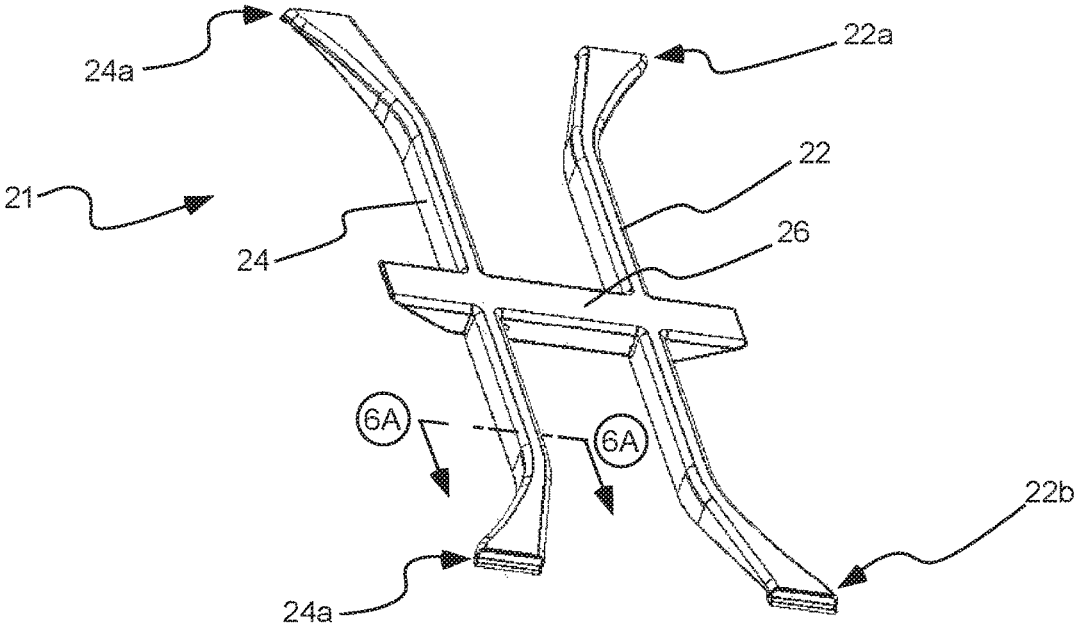
FIG. 6 is a top perspective view of a pliable arm assembly in accordance with an aspect of the invention.
Figure 6A:
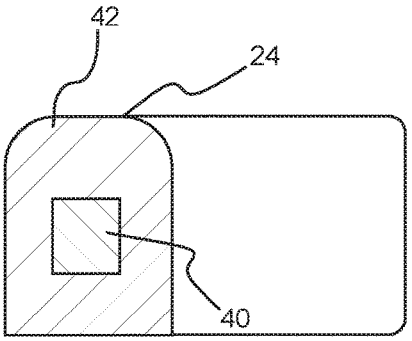
FIG. 6A is a cross-sectional view of an arm of the pliable arm assembly of FIG. 6, taken along section 6A-6A of FIG. 6.

FIG. 6A illustrates one exemplary manner in which the pliable leg 24 can be constructed. In this example, the leg includes an inner pliable material 40 encompassed by an outer flexible material 42. The inner pliable material can be formed from a material that is sufficiently flexible to allow a user to position it where desired, but also sufficiently rigid to retain an orientation once so positioned. Examples of materials suitable for this purpose include, without limitation, metals such as steel, aluminum, titanium, composites and combinations containing such materials, etc.

The outer flexible material 42 can take a variety of forms as well. In one example, this material is soft and flexible to provide to the user a comfortable interface. This flexible material can exhibit a very high coefficient of friction; that is, it can provide a very "grippy" interface. Examples of suitable flexible materials include, without limitation, rubber, silicone, PVC (polyvinyl chloride), composites and combinations containing such materials, etc.

In one embodiment of the invention, the pliable arm (for example, if 22 in FIG. 1 were considered independently) can constitute a single unit that extends through the openings (20*a*, 20*b*, in this example) and is retained by the arm restraint section 18. In another embodiment, however, the pliable arms are provided as a pliable assembly. One example of such a pliable assembly 21 is illustrated, for example, in FIG. 6 (this same assembly is included in the embodiment illustrated in FIG. 2).

As shown in FIG. 6, in this example a pliable assembly 21 is provided that includes one or more pliable arms 22, 24 coupled together by a brace 26. In this embodiment, at least a portion of the brace is retained by the arm restraint section 18 (see FIG. 5, for example), such that first and second ends of each of the pair of pliable arms are free to move relative to the brace. The brace can serve to rigidify the intermediate sections 22*c*, 24*c* of the flexible arms. This arrangement provides a secure interface between the intermediate sections of the pliable arms and the case 12 and can minimize twisting or sliding of the pliable arms within the case.

While not shown explicitly in FIG. 6, the inner pliable material 40 of the pliable arm 24 (and arm 22) can extend through the brace 26 such that each arm includes an inner core of pliable material that extends substantially from one end 22*a*, 24*a* to another end 22*b*, 24*b* of the arm 22, 24. The inner core can also be segmented, with one or more pieces extending through each end 22*a*, 24*a*, etc.

Figure 9:
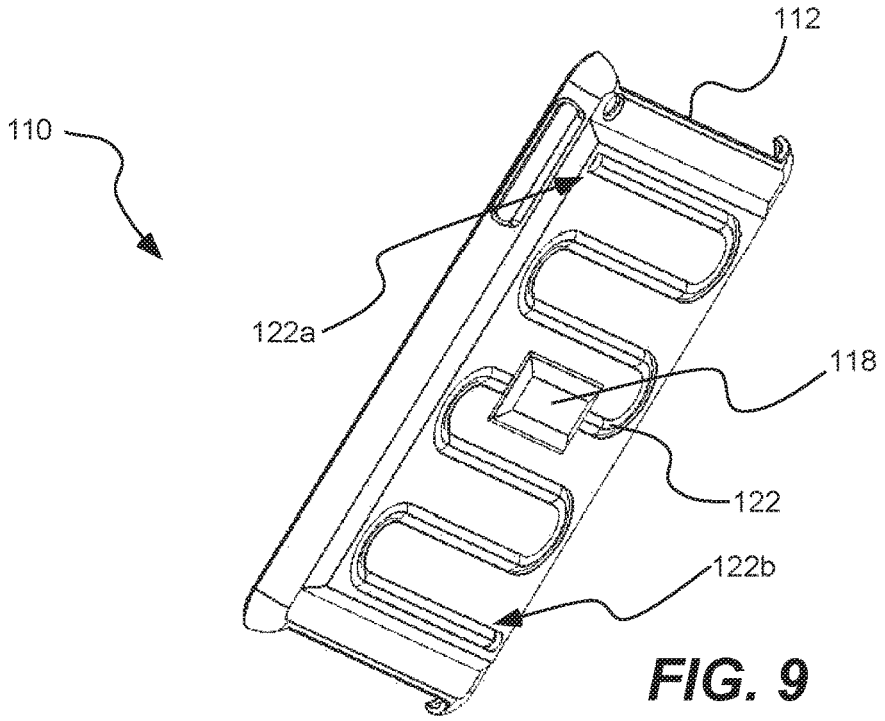
FIG. 9 is a bottom perspective view of a mobile device protective case in accordance with another aspect of the invention.
Figure 10:
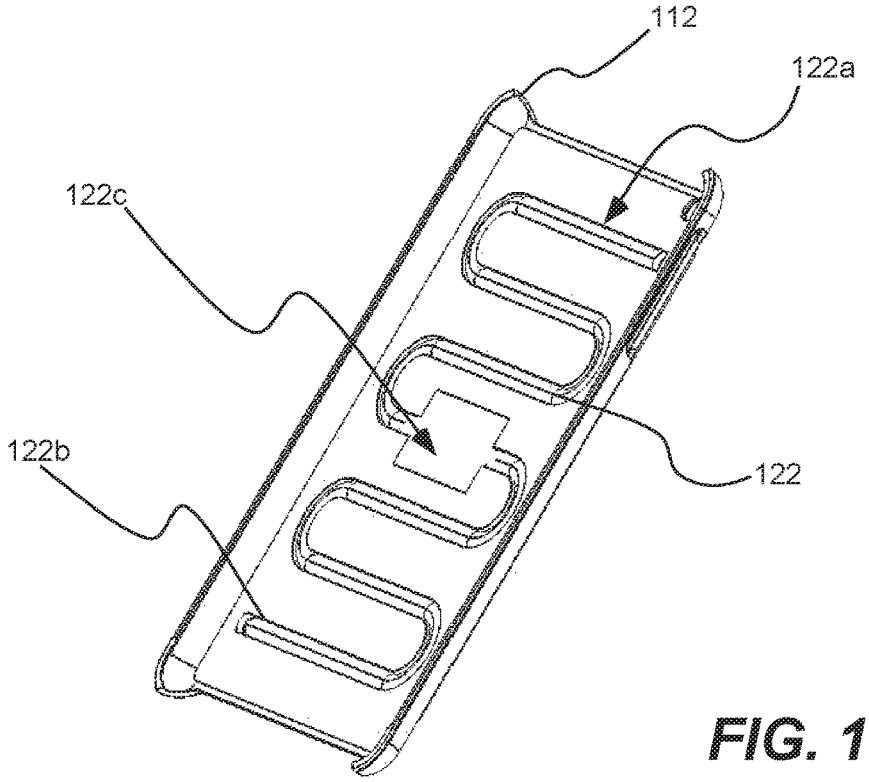
FIG. 10 is a top perspective view of the mobile device protective case of FIG. 9.

FIGS. 9 and 10 illustrate another embodiment of the invention in which assembly 110 includes a mobile device case 112 having engagement structure associated therewith (sidewalls, not numbered in this figure). As shown and discussed in earlier embodiments, the sidewalls are operable to retain a mobile device within the case. An arm restraint section 118 can be coupled to or formed in the case, and at least two open sections can be formed in or on the case adjacent the arm restraint section. In these views, the open sections are shown filled with at least one pliable arm 122 that includes a first end 122*a*, a second end 122*b* and an intermediate section 122*c*. The intermediate section can be restrained by the arm restraint section of the case such that the first and second ends of the pliable arm extend through the open sections of the case and are free to move relative to the arm restraint section to enable a user to position the first and second ends of the pliable arm relative to the mobile device.

This embodiment illustrates, among other things, the design flexibility provided by the present technology in offering pliable arms having a variety of shapes, sizes, cross-sections and, in particular, length. As shown, the flexible arms can be provided having a length greater than an overall length of the case 112. This can provide more "free" arm to wrap about auxiliary structures, and can thus provide a more secure hold for heavier or larger mobile devices. While the pliable arm 122 shown in FIGS. 9 and 10 is shown in the storage orientation, it is believed that one of ordinary skill in the art will readily appreciate the use of the pliable arm 122 in the extended, display orientation.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. An assembly for holding and displaying a mobile device, comprising:

a mobile device case having engagement structure associated therewith, the engagement structure operable to retain the mobile device within the case;

an arm restraint section, coupled to or formed in the case;

at least two open sections formed in the case adjacent the arm restraint section, the at least two open sections each having a depth;

at least one pliable arm having a first end, a second end and an intermediate section, the intermediate section being restrained by the arm restraint section of the case such that the first and second ends of the pliable arm extend through the open sections of the case and are free to move relative to the arm restraint section to enable a user to position the first and second ends of the pliable arm relative to the mobile device;

the first and second ends of the pliable arm having a thickness equal to or less than the depth of the at least two open sections such that when the first and second ends of the at least one pliable arm are stored within the at least two open sections the first and second ends of the at least one pliable arm are substantially flush with or beneath a rear surface of the mobile device case.

2. The assembly of claim 1, wherein the pliable arm is a component of a pliable assembly, the pliable assembly including a pair of pliable arms coupled together by a brace, and wherein at least a portion of the brace is retained by the arm restraint section such that first and second ends of each of the pair of pliable arms are free to move relative to the brace.

3. The assembly of claim 2, wherein the pliable arm is formed from a composite material including an inner pliable material encompassed by an outer flexible material.

4. The assembly of claim 3, wherein the inner pliable material comprises a metal and wherein the outer flexible material comprises a polymer.

5. The assembly of claim 2, wherein the inner pliable material extends through the brace.

6. The assembly of claim 1, wherein the pliable arm includes a storage orientation and a display orientation.

7. The assembly of claim 6, wherein all portions of the pliable arm can be stored below the rear outer surface when in the storage orientation.

8. The assembly of claim 1, wherein the engagement structure associated with the mobile device case comprises two or more sidewalls operable to engage the mobile device and secure it within the mobile device case.

9. The assembly of claim 1, further comprising a mobile device.

10. The assembly of claim 9, wherein the mobile device is selected from the group consisting of a cell phone, a tablet, a PDA, a GPS device, a portable music player, and a wearable electronic device.

11. The assembly of claim 1, wherein the rear surface of the mobile device case presents a flat, planar surface when the first and second ends of the at least one pliable arm are stored within the at least two open sections.

12. The assembly of claim 1, wherein the open sections are formed completely through the case.

13. An assembly for holding and displaying a mobile device, comprising;

a mobile device case capable of securely holding a mobile device, the mobile device case including a rear surface;

a pair of openings formed completely through the rear surface of the mobile device case, the at least two openings each having a depth; and a pliable arm having a first end and a second end and an intermediate section between the first and second ends;

the intermediate section of the pliable arm being restrained by a portion of the rear surface of the mobile device case while each of the first and second ends of the pliable arms extend through one of the pair of openings;

the first and second ends of the pliable arm having a thickness equal to or less than the depth of the at least two openings such that when the first and second ends of the at least one pliable arm are stored within the at least two openings, a rear surface of the mobile device case presents a substantially planar surface.

14. The assembly of claim 13, wherein the pliable arm includes a storage orientation and a display orientation.

15. The assembly of claim 13, wherein all portions of the pliable arm can be stored below the rear outer surface when in the storage orientation.

16. The assembly of claim 13, wherein the pliable arm is formed from a composite material including an inner pliable material encompassed by an outer flexible material.

17. An assembly for holding and displaying a mobile device, comprising:

a mobile device case having engagement structure associated therewith, the engagement structure operable to retain the mobile device within the case;

an arm restraint section, coupled to or formed in the case;

at least four open sections formed in the case adjacent the arm restraint section the at least four open sections each having a depth; and a pliable assembly including:

at least two pliable arms, each arm having first and second ends and an intermediate section therebetween, the first and second ends of the at least two pliable arms each having a thickness; and a brace, connecting the intermediate sections of the at least two pliable arms;

the pliable assembly being retained by the arm restraint section such that first and second ends of each of the pair of pliable arms are free to move relative to the mobile device; wherein when the first and second ends of the at least two pliable arms are stored within the at least four open sections, a rear surface of the mobile device case presents a substantially planar surface.

18. The assembly of claim 17, wherein all portions of the at least two pliable arms can be stored below the rear outer surface when in the storage orientation.

19. The assembly of claim 17, wherein the pliable arms are formed from a composite material including an inner pliable material encompassed by an outer flexible material.

* * * * *